United States Patent [19]

Jandera et al.

[11] Patent Number: 4,878,207

[45] Date of Patent: Oct. 31, 1989

[54] COMPOSITE SONAR TRANSDUCER FOR OPERATION AS A LOW FREQUENCY UNDERWATER ACOUSTIC SOURCE

[75] Inventors: Zdenek Jandera, Ashfield; Ian R. Bedwell, Randwick, both of Australia

[73] Assignee: Plessey Australia Pty. Ltd., Meadowbank, Australia

[21] Appl. No.: 242,192

[22] PCT Filed: Nov. 4, 1987

[86] PCT No.: PCT/AU87/00372

§ 371 Date: Sep. 7, 1988

§ 102(e) Date: Sep. 7, 1988

[87] PCT Pub. No.: WO88/03739

PCT Pub. Date: May 19, 1988

[30] Foreign Application Priority Data

Nov. 7, 1986 [AU] Australia ..... PH8951

[51] Int. Cl.[4] ..... H04R 17/00

[52] U.S. Cl. ..... 367/155; 367/158; 310/337

[58] Field of Search ..... 367/20, 106, 130, 153, 367/154, 155, 157, 158, 159, 160, 161, 162, 164, 165, 167, 173, 176; 310/334, 337

[56] References Cited

U.S. PATENT DOCUMENTS

| | | | |
|---|---|---|---|
| 2,242,757 | 5/1941 | Romanow | 381/190 |
| 3,325,780 | 6/1967 | Moran | 367/165 |
| 3,360,664 | 12/1967 | Straube | 367/157 |
| 3,588,381 | 6/1971 | Schafft | 381/190 |
| 4,186,323 | 1/1980 | Cragg et al. | 310/324 |
| 4,287,582 | 9/1981 | Jocquet | 367/163 |
| 4,364,117 | 12/1982 | Snow | 367/152 |
| 4,545,041 | 10/1985 | Tims et al. | 367/157 |
| 4,638,468 | 1/1987 | Francis | 367/153 |
| 4,706,230 | 11/1987 | Inoue et al. | 367/174 |
| 4,731,764 | 3/1988 | Ponchaud | 367/158 |
| 4,764,907 | 8/1988 | Dahlstrom et al. | 367/163 |

FOREIGN PATENT DOCUMENTS

| | | |
|---|---|---|
| 67418 | 8/1981 | Australia . |
| 3518055 | 11/1985 | Fed. Rep. of Germany . |
| 409040 | 4/1934 | United Kingdom . |
| 692706 | 6/1953 | United Kingdom . |

*Primary Examiner*—Brian S. Steinberger

*Attorney, Agent, or Firm*—Cushman, Darby & Cushman

[57] ABSTRACT

A low frequency sonar transducer comprising a head (1) having first and second stacks of piezo ceramic elements (2,3) in two spaced apart planes between common nodal end supports (7,8), the stacks being oppositely polarized to act in push-pull action with one stack expanding and the other contracting to cause the head (1) to bow. The transducer is prestressed with fibres (6) to prevent fracture.

16 Claims, 6 Drawing Sheets

Figure 1:
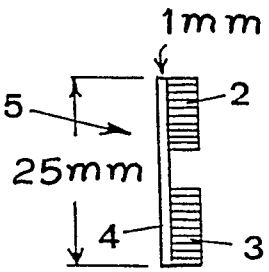

COMPOSITE SONAR TRANSDUCER FOR OPERATION AS A LOW FREQUENCY UNDERWATER ACOUSTIC SOURCE

This invention relates to a composite sonar transducer for operation as a low frequency underwater acoustic source.

Sonar transducers are already well known and usually comprise a head which is coupled to a ceramic driving assembly such as piezo-electric members so that motion of the head which is in contact with the ocean either transmits a signal outward or receives a signal translated by the piezo-electric assembly.

Problems are encountered in these units related to the frequency at which the operation is required, and the object of the present invention is to provide a unit which can operate at a relatively low frequency at relatively high efficiency.

The present invention operates on the basis of deforming a head which may act in the nature of a diaphragm so that while selected edges of the head can be stabily supported the head itself distorts under action of the drive to form the transducer.

The invention comprises ceramic elements stacked along two separate planes and arranged so that when properly driven by the ceramic composite elements, the head is bowed to provide the necessary transmission.

Thus when the ceramic elements form stacks along at least two planes in the head and are correctly driven they act in a push-pull manner.

In this way a relatively large unit can be constructed in which stacks of the ceramic elements are arranged in groups spaced apart and adapted to be driven in opposite direction in a push-pull manner so that as one group expands the other group contracts to bow the assembly.

To prevent fracture of the ceramic modules when it is driven into tension, tensile fibers, which may either be formed of KEVLAR or piano wire or other suitable tensile material, are included in the structure to load the ceramics to avoid this fracture, the whole structure thus being pre-stressed with such tensile members so that, for instance, the ceramic can see a compressive force of about 3.5–4 MPa by controlling the compliance of the tensioning section, that is number and diameter of tensioning elements, it is possible to maintain the integrity of the structure at a very high drive level.

The low frequency behavior is effected by the low mass and high compliance of the structure.

The tensioning fibers are anchored in a rigid end structure which then acts as a nodal support for the device.

The ceramic members are elements which expand in the upper direction as the lower contracts and vice-versa and thus form a structure formed of isotropic piezo materials which can readily be applied and can exert the necessary forces to cause the head so formed to bow.

In order, however, that the invention may be fully understood, embodiments thereof will now be described with reference to the accompanying drawings. Embodiments of the invention are shown, but it is to be understood that these are meant as example only and are not limiting.

Figure 2:
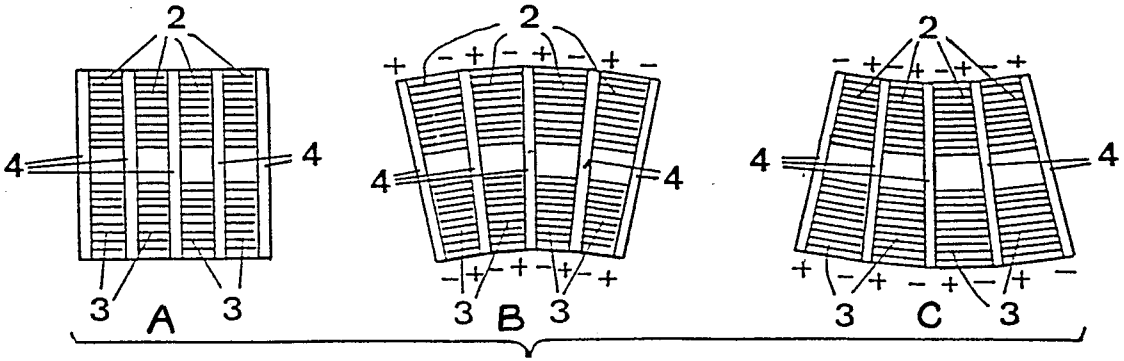
Figure 3:
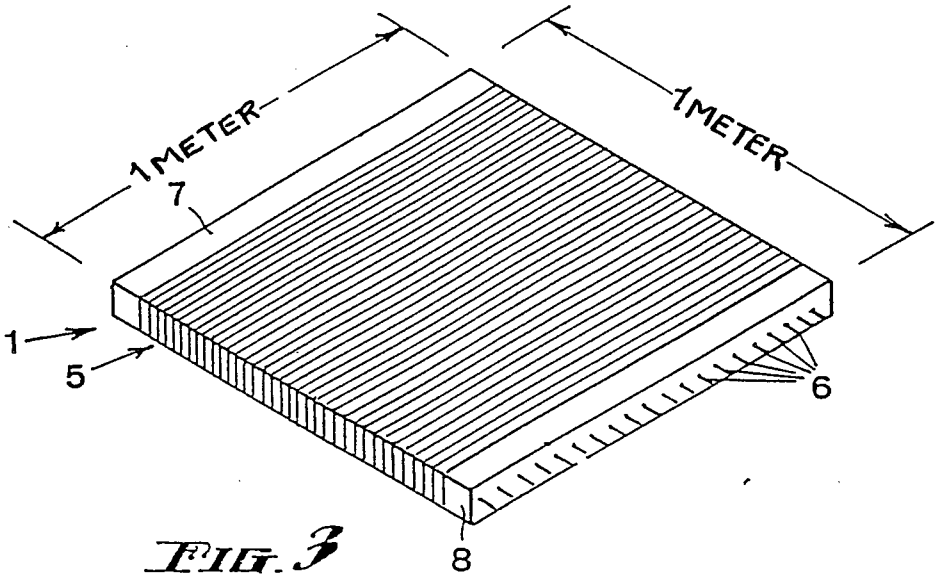
Figure 4:
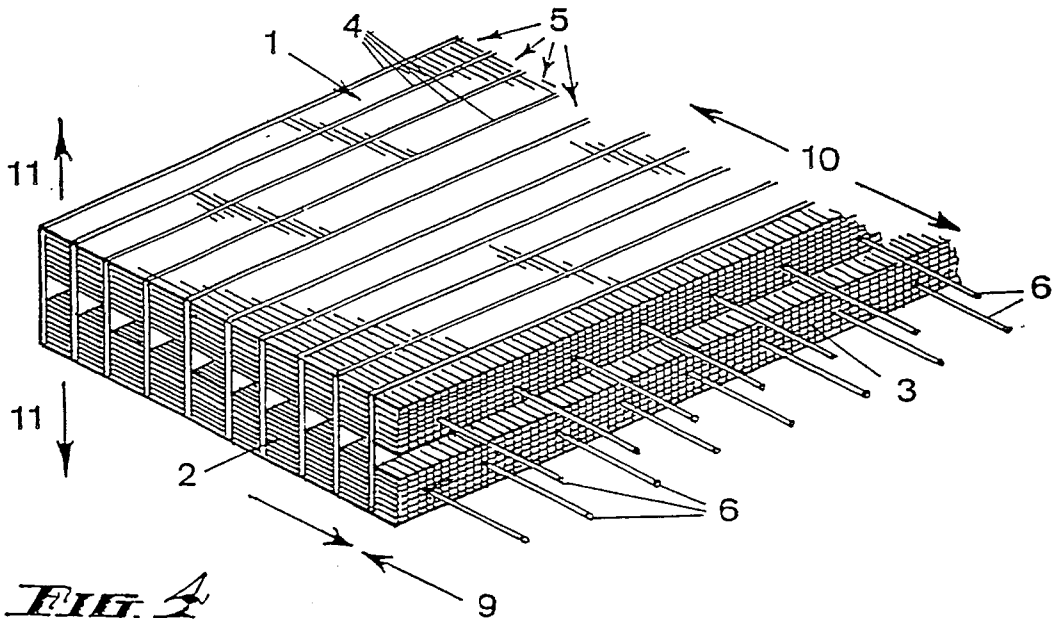
Figure 5:
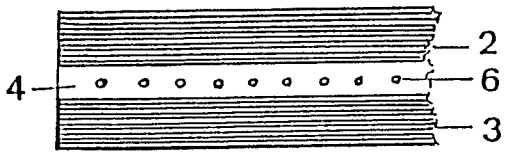
Figure 6:
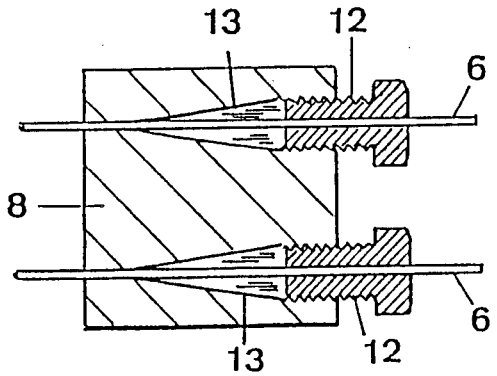
Figure 7:
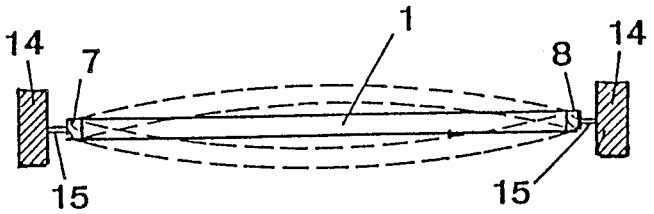
Figure 8:
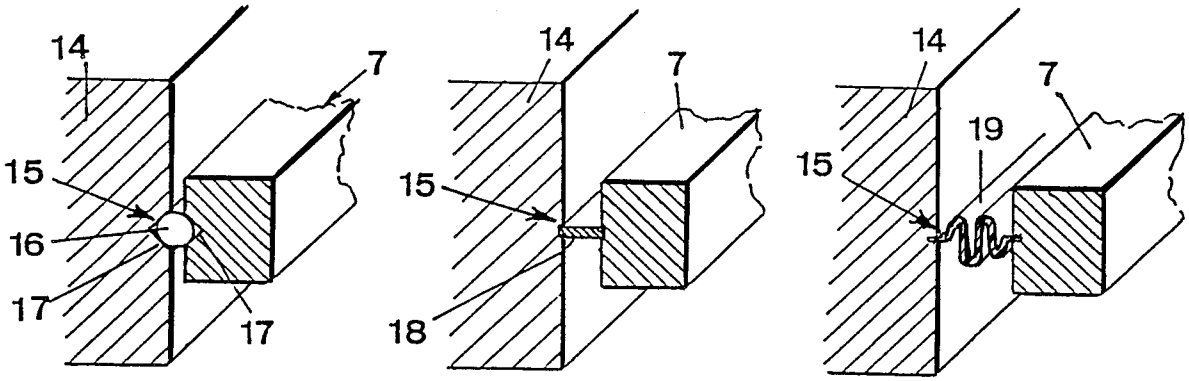
Figure 9:
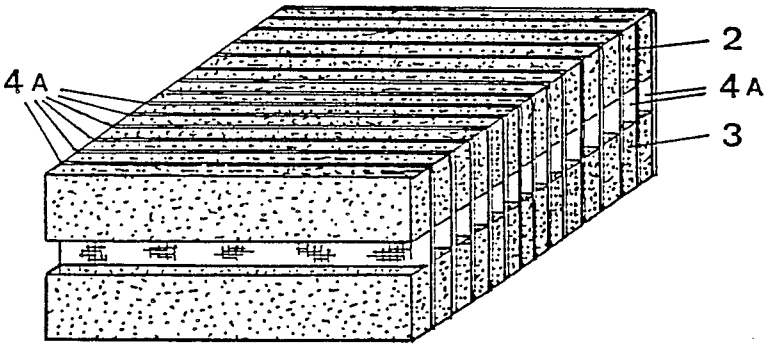

In the drawings:

FIG. 1 shows a composite element of the type used in forming the head in the invention, FIG. 2 shows at A the element when not electrically energized, at B when energized in push-pull by applying opposite polarities to the two adjacent assemblies, and at C the action when the polarities are reversed, FIG. 3 is a perspective view of a typical structure according to the invention, FIG. 4 is an enlarged sectional perspective view of the device showing the pre-stressing fibers and indicating the motions by the arrows, FIG. 5 is a sectional elevation of a modification showing centrally positioned stressing members, FIG. 6 shows a suggested clamping device to obtain the correct tension on the tensioning members, FIG. 7 is a schematic side elevation showing the unit supported between rigid end members and showing how the head bows, FIG. 8 shows at A, B and C different methods of supporting the end members of the assembly from the supports by nodal support means, 8A showing a rod which acts as a pivot between the support and end member of the assembly, 8B showing a spring section interposed between the support and end member and 8C showing how a compliant spring may be used as the nodal support means, and FIG. 9 shows a composite using printed circuit boards in the active composite structure.

Referring first to FIGS. 1, 2 and 3, the active composite transducer structure comprises a head 1 having two stacks of polarized ceramic elements 2 and 3 mounted on a support 4 to form an elemental cell 5 as shown in FIG. 1, a series of such cells 5 being stacked in a plane to form a compound planar array comprising the ceramic elements 2 and 3 as shown in FIG. 2A.

In FIG. 2B and C, shown respectively are how bowing of the head 1 in the opposite direction occurs when the stacks 2,3 of ceramic elements are electrically oppositely energized.

In FIG. 3, how a stack of 2 or 3 of ceramic transducer elements can be supported by tensioning member 6 whereby preventing overdrive showing end members 7 and 8 to which the tensioning members 6 are anchored is shown.

FIG. 4 shows the motion of the composite structure, the arrows 9 and 10 indicating the opposite motion at the two sides of the composite structure, the arrows 11 showing the signal transmitting movement of the composite structure when driven by a signal, this figure showing the composite fragmented at one end. The dimensions shown in FIGS. 1 and 3 are meant as examples only.

FIG. 5 shows a transverse section of the composite structure showing the tensioning members 6 disposed between the stacks of ceramic elements 2 and 3.

FIG. 6 shows a method of anchoring the tensioning members 6, this comprising apertured screw elements 12 having tapered portions 13 formed to be compressed on to the tension member 6 and arranged to encircle the tensioning members and lock same to the end members 7 and 8 after applying the required tension. Other tensioning devices could be used.

FIG. 7 is a schematic view showing the mode of operation of the transducer, the stacks of ceramic elements 2 and 3 and supports 4 forming the transducer head 1 which is carried by rigid support members 14.

The end members 7 and 8 of the transducer may be supported from the support members 14 by any nodal supports 15 which allow the bowing movement of the head 1 referred to, and in FIG. 8A is shown how a pivot rod 16 can engage in grooves 17 formed respectively in the support member 14 and the end members 7 and 8 to form the nodal support.

In FIG. 8B a spring section 18 forms the nodal support while in FIG. 8C a compliant spring 19 forms the nodal support 15.

FIG. 9 illustrates how the supports 4 can be in the form of printed circuit boards 4A, this facilitating electrical circuitry.

It will be appreciated, as stated earlier herein, that constructional details can be varied within the spirit of the invention, the invention relating to a push-pull assembly adapted for low frequency-active sonar transducers in which the transducer is actuated by bowing a head formed by an assembly of ceramics under electrical activation, using tensioning means to prevent fracture of the ceramics by overdrive.

The system of transmitting low frequency sonar signals according to this invention consists in energizing a transducer head 1 comprising first and second stacks 2,3 of piezo ceramic elements arranged in two spaced apart planes between common nodal end supports, arranging the elements of the first stack 2 to be polarized in a selected direction, arranging the elements of the second stack to be polarized in the opposite direction, and passing an electrical signal through both stacks to cause a push-pull action on the two stacks 2,3 which one expanding as the other contracts to bow the transducer head 1 signal-wise.

We claim:

1. A composite sonar transducer useful as an underwater acoustic source comprising:

a head formed by a series of elemental cells of piezoceramic elements, each elemental cell comprising a cell support and first and second stacks of said piezo-ceramic elements, said first and second stacks being carried by said support, said elemental cells being positioned so as to form a planar array of elemental cells to form said head;

said first and second stacks being arranged along two separate planes positioned about a central plane of said head, said of said first stack being positioned in a polar orientation opposite to those of said second stack;

nodal supports positioned on said central plane between end members on said planar array; and support members for said head and means to connect the stacks of said piezo-ceramic elements into an electrical circuit.

2. Apparatus as in claim 1 arranged wherein said piezo-ceramic elements cause said head to bow when an electrical signal is applied to said first and second stacks whereby one stack expands and the other contracts.

3. Apparatus as in claim 2 further comprising tensioning members which extend through said head and are anchored in said end members of said head.

4. Apparatus as in claim 3 wherein said tensioning members extend through said first and second stacks.

5. Apparatus as in claim 3 wherein said tensioning members extend through a space between said first and second stacks.

6. Apparatus as in claim 1 wherein said stack supports are printed circuit boards.

7. A composite sonar transducer for operation as an underwater acoustic source comprising:

an array of elemental cells;

end members confining said array therebetween;

tensioning members passing through said elemental cells;

anchoring means for said tensioning members located in said end members; and nodal supports to engage said end members;

said elemental cells each comprising a stack support and first and second stacks of piezo-ceramic elements, said first stack being arranged on one side of a central plane and said second stack being arranged on an opposite side of said central plane, said nodal supports being arranged on said central plane, said first and second stacks having opposite polar orientation, and said first and second stacks being connected in an electrical circuit.

8. Apparatus as in claim 7 wherein said stack supports are printed circuit boards arranged so as to form said electrical circuit.

9. Apparatus as in claim 7 wherein said anchoring means comprise tapering elements arranged to be compressed onto said tensioning members whereby locking said tensioning members to said end members.

10. Apparatus as in claim 7 wherein said nodal supports comprise:

fixed supports; and pivot rods engaged in grooves in said end members and said fixed supports.

11. Apparatus as in claim 7 wherein said nodal supports comprise:

fixed support; and spring means engaged between said end members and said fixed supports.

12. A method for transmitting sonar signals comprising the steps of:

electrically energizing a transducer head formed by arranging an array of elemental cells between end supports, each said cell being formed by mounting first and second stacks of piezo-ceramic elements in two planes with space therebetween on a support about a central plane passing through said end supports;

arranging said elements of said first stack so as to polarize said elements oppositely to said elements of said second stack;

engaging said end supports on nodal supports with said nodal supports arranged on said central plane; and arranging circuit means so as to connect said first and second stacks into an electrical circuit.

13. The method of claim 12 wherein said supports of said elemental cells comprise printed circuit boards connected so as to transmit an electrical signal through said first and second stacks.

14. The method of claim 12 wherein tensioning members are positioned through said elemental cells with said tensioning members being anchored in said end supports so as to limit expansion of said piezo-ceramic elements of said elemental cells.

15. The method of claim 14 further comprising the step of applying a selected tension to said tensioning members and then locking said tensioning members to said end supports.

16. The method claim 12 wherein said nodal supports are engaged on a fixed support and passing an electrical signal through said first and second stack causes said head to bow.

* * * * *